US008833451B2

(12) United States Patent
Steele et al.

(10) Patent No.: US 8,833,451 B2
(45) **Date of Patent: *Sep. 16, 2014**

(54) WINDOW JOINT FOR LATERAL WELLBORE CONSTRUCTION AND METHOD FOR OPENING SAME

(75) Inventors: David Joe Steele, Arlington, TX (US); Neil Hepburn, Ponteland (GB)

(73) Assignee: Halliburton Energy Services, Inc., Houston, TX (US)

( * ) Notice: Subject to any disclaimer, the term of this patent is extended or adjusted under 35 U.S.C. 154(b) by 282 days.

This patent is subject to a terminal disclaimer.

(21) Appl. No.: 13/113,747

(22) Filed: May 23, 2011

(65) Prior Publication Data

US 2012/0298362 A1 Nov. 29, 2012

(51) Int. Cl.
*E21B 29/06* (2006.01)
*E21B 41/00* (2006.01)
*E21B 23/12* (2006.01)

(52) U.S. Cl.
CPC ..... *E21B 29/06* (2013.01); *E21B 41/0035* (2013.01); *E21B 23/002* (2013.01)
USPC ..... 166/298; 166/242.1

(58) Field of Classification Search
USPC ..... 166/298, 380, 117.5, 117.6, 242.1
See application file for complete search history.

(56) References Cited

U.S. PATENT DOCUMENTS

| | | | | |
|---|---|---|---|---|
| 4,706,482 | A | 11/1987 | Barber | |
| 6,012,526 | A * | 1/2000 | Jennings et al. | 166/298 |
| 6,024,168 | A * | 2/2000 | Kuck et al. | 166/297 |
| 7,051,810 | B2 | 5/2006 | Clemens et al. | |
| 2009/0255687 | A1 | 10/2009 | McCullough et al. | |
| 2009/0288829 | A1 | 11/2009 | Parlin | |

OTHER PUBLICATIONS

ISRWO, International Searching Authority, KIPO, PCT/US2012/034873, Nov. 14, 2012.

* cited by examiner

*Primary Examiner* — David Andrews
(74) *Attorney, Agent, or Firm* — Lawrence R. Youst

(57) ABSTRACT

A system for opening a window (320) in lateral wellbore construction. The system includes a window joint (300) that is operable to be interconnected within a casing string. The window joint (300) has a window (304) formed therein that is defined by at least one score line (306) that creates a preferentially weaken region within the window joint (300) enabling internal removal of the window (304) in a predictable manner without generating wellbore debris. A window removal tool (310) is operable to be run in the casing string. The window removal tool (310) is operably engagable with the window (304) such that actuation of the window removal tool (310) internally removes the window (304) from the window joint (300), thereby opening the window (320).

11 Claims, 7 Drawing Sheets

28
10
26
12
20
18
22
16
24
30
32
34
40
36
38
14

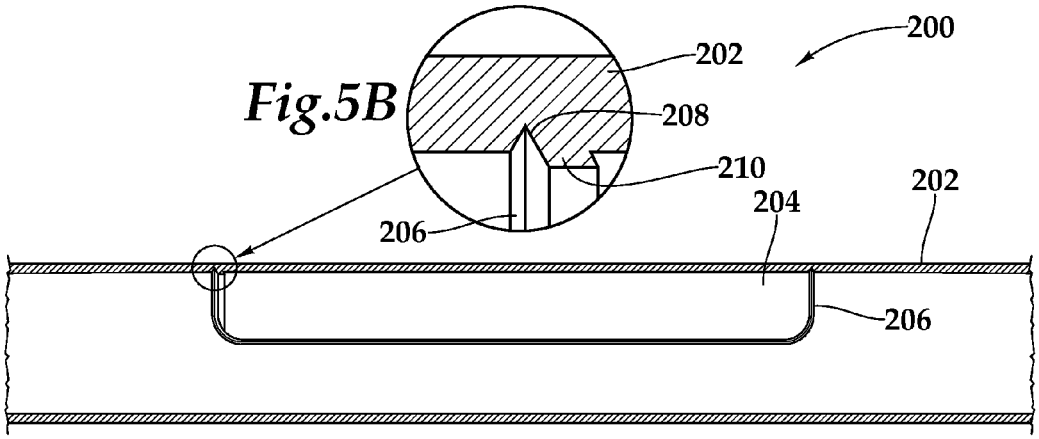
Fig.5B
Fig.5A
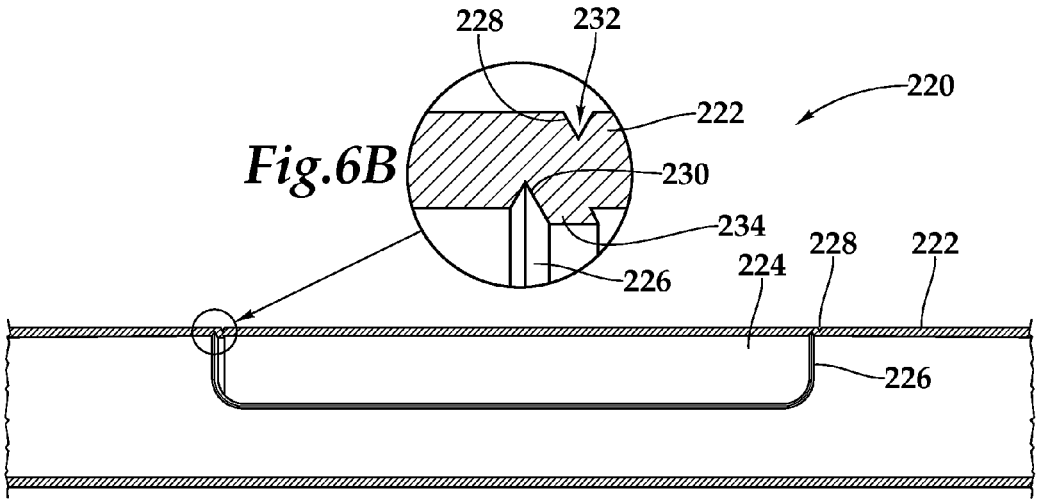
Fig.6B
Fig.6A
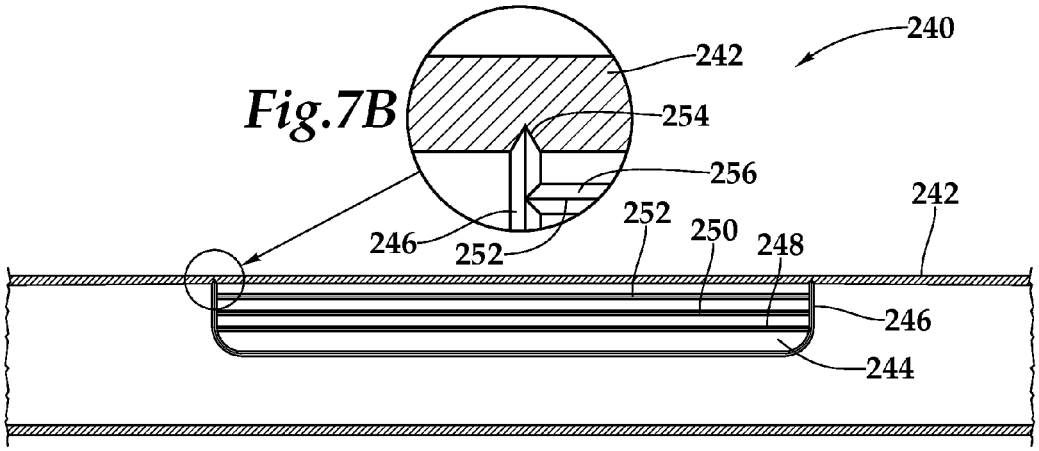
Fig.7B
Fig.7A

WINDOW JOINT FOR LATERAL WELLBORE CONSTRUCTION AND METHOD FOR OPENING SAME

TECHNICAL FIELD OF THE INVENTION

This invention relates, in general, to equipment utilized in conjunction with operations performed in subterranean wells and, in particular, to a window joint for lateral wellbore construction and a method for opening same.

BACKGROUND OF THE INVENTION

Without limiting the scope of the present invention, its background will be described in relation to forming a window in a casing string for a multilateral well, as an example.

In multilateral wells it is common practice to drill a branch or lateral wellbore extending laterally from an intersection with a main or parent wellbore. Typically, once the casing string is installed and the parent wellbore has been completed, a whipstock is positioned in the casing string at the desired intersection and then a rotating mill is deflected laterally off of the whipstock to form a window through the casing sidewall.

Once the casing window is created, the lateral wellbore can drilled. In certain lateral wellbores, when the drilling operation has been completed, a casing string is installed in the lateral branch. Casing the lateral branch may be accomplished with the installation of a liner string that is supported in the main wellbore and extends a desired distance into the lateral wellbore. Once the lateral casing string is installed and the lateral wellbore has been completed, it may be desirable to reestablish access to the main wellbore. In such cases, a rotating mill may be use to form an access window through the lateral casing sidewall.

It has been found, however, that the milling process used to form the lateral window and the main wellbore access window usually produces a large amount of debris, such as small pieces of the metal casing, which accumulate in the parent wellbore. This debris may make the whipstock difficult to retrieve after the milling process is completed. In addition, even after the whipstock is retrieved, the debris may cause other problems, such as plugging flow control devices, damaging seals, obstructing seal bores, interfering with passage of equipment past the intersection and the like.

Accordingly, a need has arisen for an improved system and method of opening windows in the casing strings during multilateral wellbore construction. In addition, a need has arisen for such an improved system and method that does not require the use of a mill that generates wellbore debris during multilateral wellbore construction.

SUMMARY OF THE INVENTION

The present invention disclosed herein is directed to systems and methods of using a window joint in a casing string for lateral wellbore construction. The systems and methods of the present invention do not require the use of a mill to open the window, thereby reducing the wellbore debris generated during lateral wellbore construction.

In one aspect, the present invention is directed to a window joint for lateral wellbore construction. The window joint includes a tubular member that is operable to be interconnected within a tubular string. A window is formed in the tubular member. The window is defined by at least one score line that creates a preferentially weaken region within the tubular member enabling internal removal of the window in a predictable manner without generating wellbore debris.

In one embodiment, the at least one score line is formed in the window joint prior to installing the window joint in the tubular string. In another embodiment, the at least one score line is formed in the window joint after installing the window joint in the tubular string. In one embodiment, the at least one score line is formed on an interior surface of the tubular member. In another embodiment, the at least one score line is formed on an exterior surface of the tubular member. In a further embodiment, the at least one score line includes at least one score line formed on an interior surface of the tubular member and at least one score line formed on an exterior surface of the tubular member. In some embodiments, the at least one score line includes a plurality of longitudinally extending score lines. In other embodiments, the at least one score line includes a plurality of circumferentially extending score lines. In certain embodiments, a tab extends radially inwardly from an interior surface of the window. In other embodiments, a tab may be formed in the window downhole. In either embodiment, the tab is operably engagable with a window removal tool to enable internal removal of the window. Preferably, the window has a circumferential width up to about 170 degrees.

In another aspect, the present invention is directed to a system for opening a window in lateral wellbore construction. The system includes a window joint that is operable to be interconnected within a casing string. The window joint has a window that is formed therein. The window is defined by at least one score line that creates a preferentially weaken region within the window joint enabling internal removal of the window in a predictable manner without generating wellbore debris. A window removal tool is operable to be run in the casing string and operably engagable with the window such that actuation of the window removal tool internally removes the window from the window joint, thereby opening the window.

In one embodiment, the window removal tool includes an anchor assembly, a power assembly and an operating tool. The anchor assembly is operable to secure the window removal tool in the casing string. The power assembly is operable to provide movement to the operating tool. The operating tool is operably engagable with the window. In this embodiment, the power assembly may be a mechanically operated power assembly, an electrically operated power assembly, a hydraulically operated power assembly, hydrostatically operated power assembly or the like. In certain implementations, the power assembly is operable to provide longitudinal movement to the operating tool. In other implementations, the power assembly is operable to provide rotational movement to the operating tool.

In a further aspect, the present invention is directed to a method for opening a window in lateral wellbore construction. The method includes interconnecting a window joint within a casing string, the window joint having a window formed therein defined by at least one score line that creates a preferentially weaken region within the window joint enabling internal removal of the window in a predictable manner, installing the casing string in a wellbore, running a window removal tool in the casing string, operatively engaging the window removal tool with the window, actuating the window removal tool and internally removing the window from the window joint with the window removal tool, thereby opening the window.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which:

FIG. 5A is a cross sectional view of a window joint having a window according to an embodiment of the present invention;

FIG. 5B is an enlarged view of a section of a window joint having a window according to an embodiment of the present invention;

FIG. 6A is a cross sectional view of a window joint having a window according to an embodiment of the present invention;

FIG. 6B is an enlarged view of a section of a window joint having a window according to an embodiment of the present invention;

FIG. 7A is a cross sectional view of a window joint having a window according to an embodiment of the present invention;

FIG. 7B is an enlarged view of a section of a window joint having a window according to an embodiment of the present invention;

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
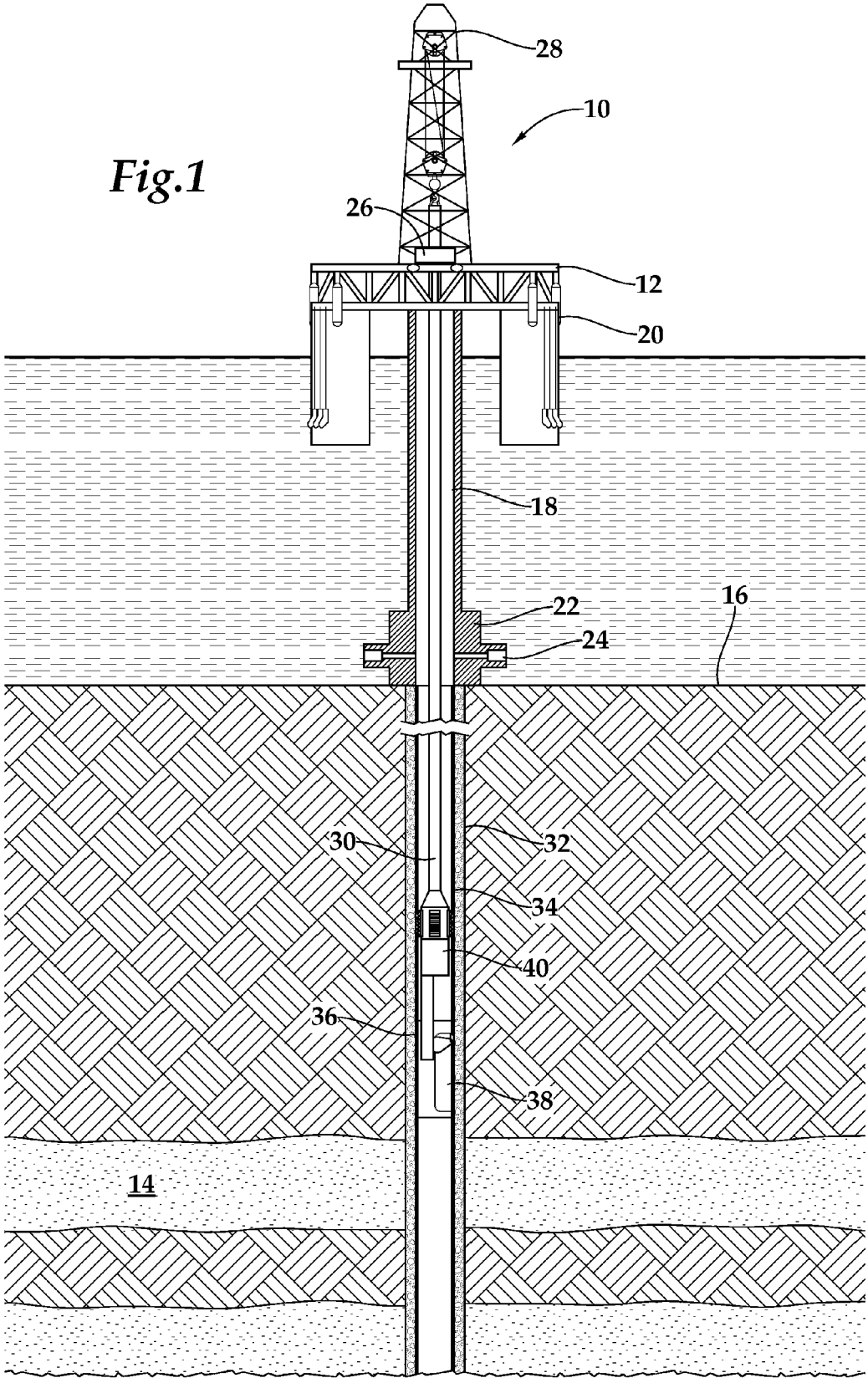
FIG. 1 is a schematic illustration of an offshore platform during the opening of a window in a casing string for lateral wellbore construction according to an embodiment of the present invention.

Referring to FIG. 1, an offshore oil and gas platform performing a window opening operation in a casing string for lateral wellbore construction is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings such as drill string 30. A main wellbore 32 has been drilled through the various earth strata including formation 14. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 34 is cemented within main wellbore 32. The term "casing" is used herein to designate a tubular string used to line a wellbore. It is to be noted, however, that a casing may actually be of the type known to those skilled in the art as a "liner" that is hung from the casing thereabove and may be made of any material, such as steel or composite material and may be segmented or continuous, such as coiled tubing.

The casing string 34 includes a window joint 36 of the present invention interconnected therein. As illustrated, window joint 36 is positioned at a desired intersection between main wellbore 32 and a branch or lateral wellbore to be subsequently drilled. The terms "branch" and "lateral" wellbore are used herein to designate a wellbore which is drilled outwardly from its intersection with another wellbore, such as a parent or main wellbore. A branch or lateral wellbore may have another branch or lateral wellbore drilled outwardly therefrom. Window joint 36 includes a window 38 that is preferable defined by internal score lines, external score lines or both that create a preferentially weakened region within window joint 36 to enable removal of window 38 in a predictable manner without generating wellbore debris. As described below, window 38 may be a preformed window, wherein the score lines are formed in window joint 36 prior to interconnecting window joint 36 within casing string 34 and installing window joint 36 in wellbore 32. It is to be understood by those skilled in the art, however, that window 38 may be formed in window joint 36 after interconnecting window joint 36 within casing string 34 and installing window joint 36 in wellbore 32 without departing from the principles of the present invention.

Disposed within casing string 34 is a window removal tool 40 that has been run in wellbore 32 on the end of a conveyance depicted as drill string 30. Depending on the type of window removal tool used, the conveyance could alternatively be coiled tubing including composite coiled tubing, electric line, wireline or the like. Window removal tool 40 may be mechanically operated, electrically operated, hydraulically operated, hydrostatically operated or the like. In a mechanically operated embodiment of window removal tool 40, drill string 30 may be used to generate the required longitudinal force or rotational torque to open and remove window 38. In an electrically operated embodiment of window removal tool 40, a downhole electrical motor powered by a surface or downhole source of electricity may be used to generate the required longitudinal force or rotational torque to open and remove window 38. In a hydraulically operated embodiment of window removal tool 40, a pressurized fluid from a surface source or downhole fluid reservoir may be used to generate the required longitudinal force or rotational torque to open and remove window 38. In a hydrostatically operated embodiment of window removal tool 40, the pressurized fluid source of the wellbore may be used to generate the required longitudinal force or rotational torque to open and remove window 38. Additionally, window removal tool 40 may use combinations of the listed operational modes to open and remove window 38.

As one example, window removal tool 40 may include some or all of the components of the downhole force generator described in U.S. Pat. No. 7,051,810, which is assigned to Halliburton Energy Services, Inc., and which is incorporated by reference herein for all purposes. In such an embodiment, window removal tool 40 may includes a power assembly such as a downhole power unit for generating the force required to remove window 38, an anchor assembly for securing window removal tool 40 in casing string 34 and an operating tool for interacting with and removing window 38.

A particular implementation of the downhole power unit includes an elongated housing, a motor disposed in the housing and a sleeve connected to a rotor of the motor. The sleeve is a rotational member that rotates with the rotor. A moveable member such as moveable shaft is received within the threaded interior of the sleeve. Operation of the motor rotates the sleeve which causes the moveable shaft to move longitudinally. Accordingly, when the downhole power unit is longitudinally secured within casing 34 and the moveable member is operably associated with window 38, a longitudinal force is applied to the operating tool which opens window 38. Alternatively or additionally, the moveable member could operate as a rotational member such that torque is transmitted between the operating tool and window 38.

Preferably, a microcontroller is used to control the operation of the downhole power unit. The microcontroller is operationally connected to the downhole power unit to actuate movement of the moveable member when desired. In one embodiment, the microcontroller includes a microprocessor which operates under control of a timing device and a program stored in a memory. The program in the memory includes instructions which cause the microprocessor to control the downhole power unit. The microcontroller operates under power from a power supply which can be at the surface of the well or, preferably, contained within the downhole power unit. For a particular implementation, the power source provides the electrical power to both the motor of the downhole power unit and the microcontroller. When the downhole power unit is at the target location, the microcontroller commences operation of the downhole power unit as programmed. For example, with regard to controlling the motor that operates the sleeve receiving the moveable member, the microcontroller sends a command to energize the motor to rotate the sleeve in the desired direction to either extend or retract the moveable member at the desired speed or rotate the moveable member at the desire speed and torque. One or more sensors monitor the operation of the downhole power unit and provide responsive signals to the microcontroller. When the microcontroller determines that a desired result has been obtained, it stops operation of the downhole power unit.

Even though FIG. 1 depicts the present invention in a vertical section of the main wellbore, it should be understood by those skilled in the art that the present invention is equally well suited for use in wellbores having other directional configurations including horizontal wellbores, deviated wellbores, slanted wellbores, lateral wellbores and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts the present invention operating from an offshore floating platform, it should be understood by those skilled that the present invention is equally well suited for operating from a fixed offshore platform or during onshore operations.

Figure 2:
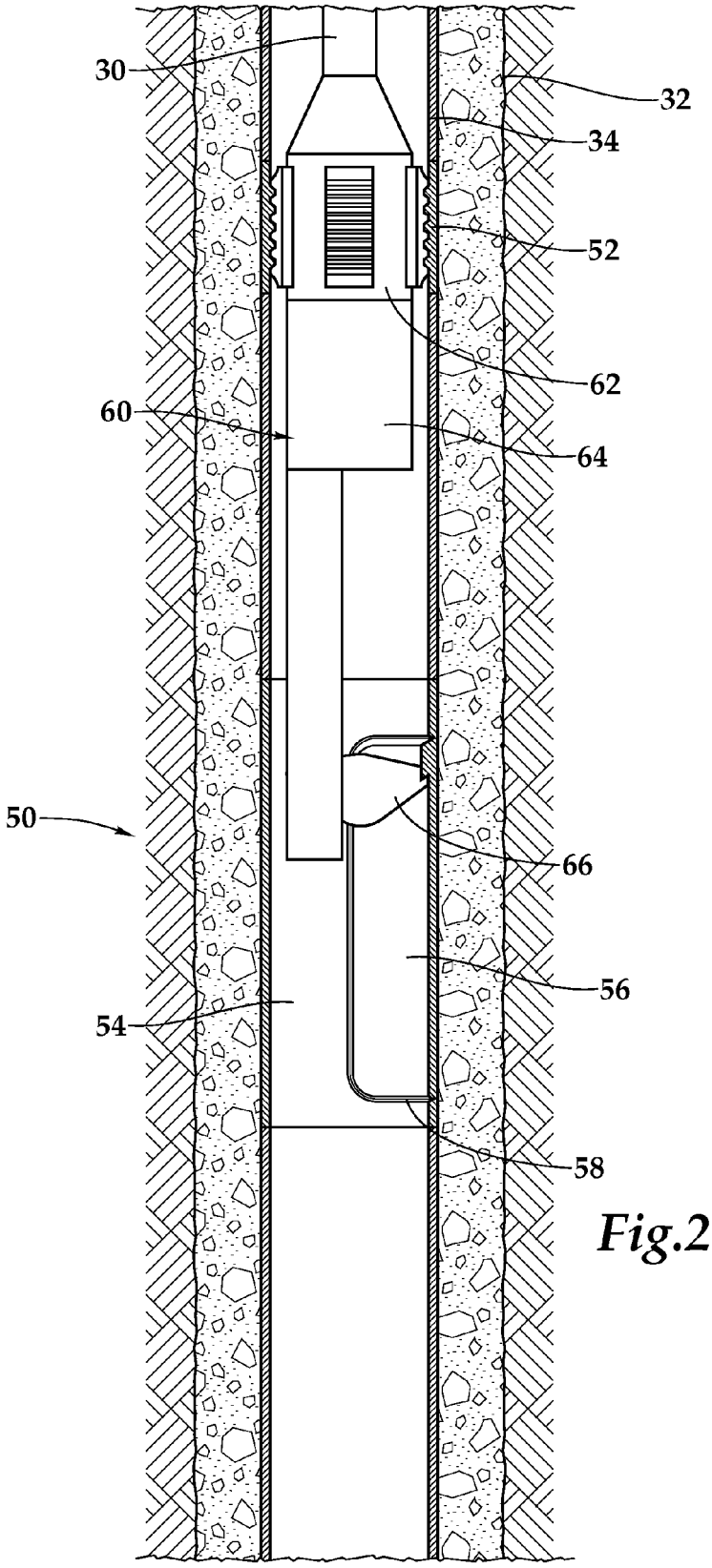
FIG. 2 is a schematic illustration of a well system depicting the opening of a window in a casing string for lateral wellbore construction according to an embodiment of the present invention.

Referring now to FIG. 2, a well system depicting the opening of a window in a casing string for lateral wellbore construction of the present invention is schematically depicted and generally designated 50. In the illustrated embodiment, casing string 34 includes a latch coupling 52. As explained in further detail below, latch coupling 52 preferably has a unique profile including a plurality of preferential circumferential alignment elements that is operable to receive a latch assembly therein and locate the latch assembly in a particular circumferential orientation.

Casing string 34 also includes a window joint 54 that has a preformed window 56. Preformed window 56 is defined by an internal score line 58 that creates a preferentially weakened region within window joint 54 to enable removal of preformed window 56 in a predictable manner without generating wellbore debris. Disposed within casing string 34 is a window removal tool 60 that has been run in wellbore 32 on the end of a conveyance depicted as drill string 30. In the illustrated embodiment, window removal tool 60 includes a latch assembly 62, a power assembly 64 and an operating tool 66.

Latch assembly 62 preferably has a unique outer profile that is operable to engage with the unique inner profile and preferential circumferential alignment elements of latch coupling 52. When latch assembly 62 operably engages with latch coupling 52, operating tool 66 will be located within casing string 34 relative to window joint 54 and preformed window 56 such that operating tool 66 opens and removes preformed window 56 from window joint 54 when power assembly 64 is operated. Power assembly 64 provides the power required to remove preformed window 56 from window joint 54 when latch assembly 62 operably engages with latch coupling 52. As described above, power assembly may be mechanically operated, hydraulically operated, electrically operated, hydrostatically operated or the like so long as power assembly 64 is operable to provide sufficient longitudinal force or rotational torque to operating tool 66. Operating tool 66 operably engages with preformed window 58, as described below, such that suitable longitudinal force or rotational torque provided by power assembly 64 enables operating tool 66 to open and remove preformed window 56 from window joint 54.

Figure 3:
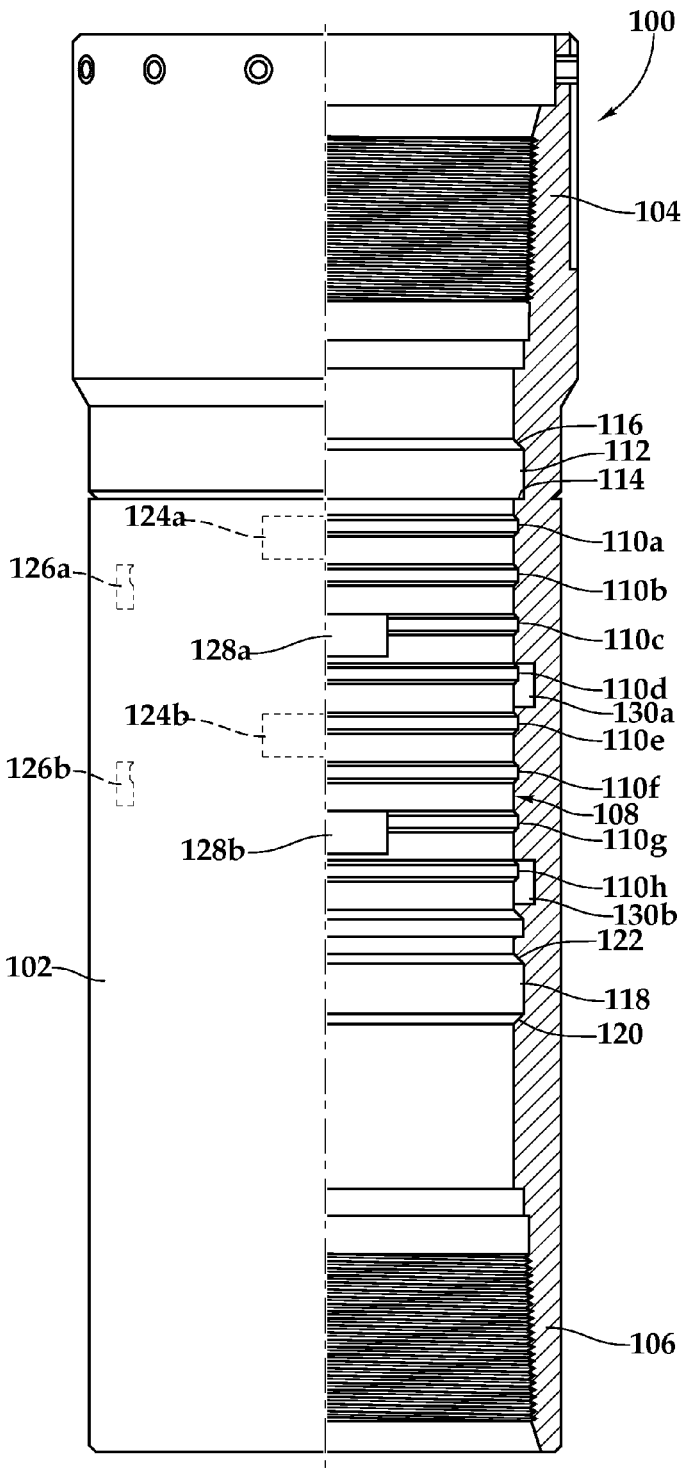
FIG. 3 is a quarter sectional view of a latch coupling for use during the opening of a window in a casing string for lateral wellbore construction according to an embodiment of the present invention.

Referring next to FIG. 3, one embodiment of a latch coupling operable for use with a window removal tool for lateral wellbore construction of the present invention is depicted and generally designated 100. Latch coupling 100 is representative of latch coupling 52 depicted above; however, as discussed above, each latch coupling will have a unique inner profile and preferential circumferential alignment elements that are different from that of other latch couplings to enable selective engagement with a matching or mating outer profile of the desired latch assembly. Accordingly, latch coupling 100 is described herein to illustrate the type of elements and combination of elements that can be used to create any number of unique profiles as contemplated by the present invention.

Latch coupling 100 has a generally tubular body 102 and may be coupled to other tools or tubulars such as casing string 34 via threaded connections 104, 106. Latch coupling 100 includes an internal profile 108 including a plurality of axially spaced apart recessed grooves **110*a*-110*h* that extend circumferentially about the inner surface of latch coupling 100. Preferably, recessed grooves 110*a*-110*h* extend about the entire circumferential internal surface of latch coupling 100**.

Internal profile 108 also includes an upper groove 112 having a lower square shoulder 114 and an upper angled shoulder 116. Internal profile 108 further includes a lower groove 118 having a lower angled shoulder 120 and an upper angled shoulder 122.

Internal profile 108 also has a plurality of preferential circumferential alignment elements depicted as a plurality of slots disposed within the inner surface of latch coupling 100. In the illustrated embodiment, there are four sets of two slots that are disposed in different axial and circumferential positions or locations within the inner surface of latch coupling 100. For example, a first set of two slots or recesses 124*a*, 124*b* (collectively recesses 124) are disposed within the inner surface of latch coupling 100 at substantially the same circumferential positions and different axial positions. A second set of two slots or recesses 126*a*, 126*b* (collectively recesses 126) are disposed within the inner surface of latch coupling 100 at substantially the same circumferential positions and different axial positions. A third set of two slots or recesses 128*a*, 128*b* (collectively recesses 128) are disposed within the inner surface of latch coupling 100 at substantially the same circumferential positions and different axial positions. A fourth set of two slots or recesses 130*a*, 130*b* (collectively recesses 130) are disposed within the inner surface of latch coupling 100 at substantially the same circumferential positions and different axial positions.

As shown, recesses 126 are disposed within the inner surface of latch coupling 100 at a ninety degree angle circumferentially from recesses 124. Likewise, recesses 128 are disposed within the inner surface of latch coupling 100 at a ninety degree angle circumferentially from recesses 126. Finally, recesses 130 are disposed within the inner surface of latch coupling 100 at a ninety degree angle circumferentially from recesses 128. Preferably, recesses 124, 126, 128, 130 only partially extend circumferentially about the internal surface of latch coupling 100.

Profile 108 including the preferential circumferential alignment elements creates a unique mating pattern operable to cooperate with an external key profile associated with a desired latch assembly to axially and circumferentially anchor and orient a window removal tool in a particular desired circumferential orientation relative to the window joint of the casing string. The specific profile of each latch coupling can be created by varying one or more of the elements or parameters thereof. For example, the thickness, number and relative spacing of the recessed grooves can be altered, the axial and circumferential spacing of the preferential circumferential alignment elements can be altered, the axial and circumferential thickness of the preferential circumferential alignment elements can be altered, the number of preferential circumferential alignment elements can be altered and the like.

Figure 4:
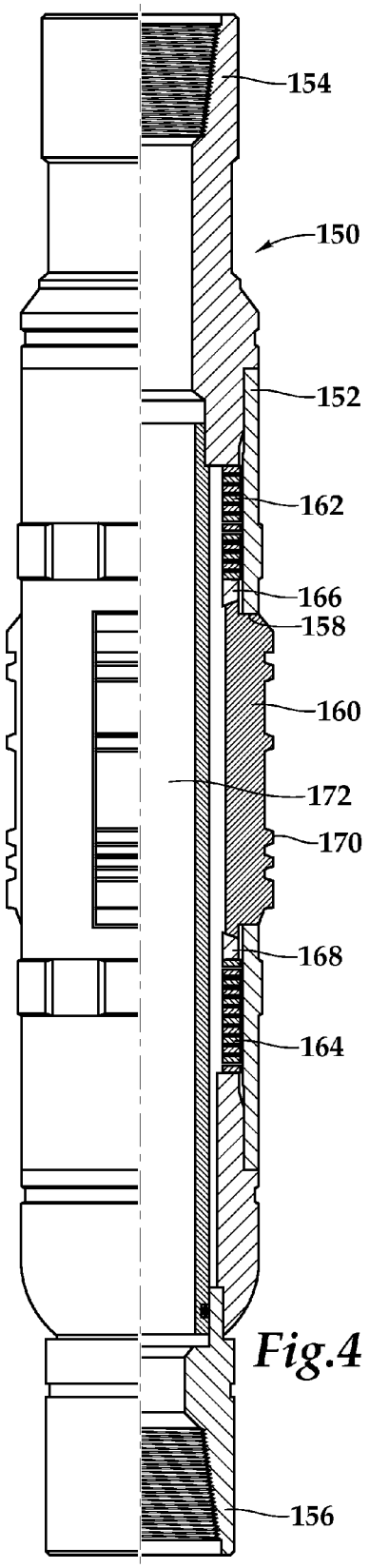
FIG. 4 is a quarter sectional view of a latch assembly for use during the opening of a window in a casing string for lateral wellbore construction according to an embodiment of the present invention.

Referring next to FIG. 4, an anchor assembly depicted as a latch assembly operable for use with a window removal tool for lateral wellbore construction of the present invention is depicted and generally designated 150. Latch assembly 150 includes a latch housing 152 may be coupled to other tools or tubulars such a power assembly via threaded connections 154, 156. Latch housing 152 has a plurality of elongated openings 158 formed therethrough. A plurality of spring operated keys 160 extend through elongated openings 158. Keys 160 are radially outwardly biased by Belleville springs 162, 164 that urge conical wedges 166, 168 under keys 160 from above and below. Alignment between keys 160 and openings 158 as well as appropriate spacing between keys 160 are maintained by latch housing 152, which also limits the outward displacement keys 160.

The anchoring and orienting functions of latch assembly 150 with a latch coupling having the appropriate mating profile are performed by engagement between external profiles 170 formed on each of the keys 160 and inner profile and preferential circumferential alignment elements formed in the latch coupling. Different profiles 170 are formed on keys 160 of latch assembly 150, to correspond to different radial portions of the inner profile and preferential circumferential alignment elements formed in the latch coupling. When latch assembly 150 is disposed within the corresponding latch coupling, profiles 170 on keys 160 initially engage the inner profile and thereby prevent further longitudinal displacement of latch assembly 150 relative to the latch coupling. Latch assembly 150 is then rotated within the latch coupling, until each of the profiles 170 engages the corresponding preferential circumferential alignment elements formed in the latch coupling, thereby preventing further rotational displacement of latch assembly 150 relative to the latch coupling. Latch assembly 150 includes a central bore 172 which allows fluids and other tools or tubulars to pass therethrough.

Referring now to FIGS. 5A-5B, a window joint for use in lateral wellbore construction is schematically illustrated and generally designated 200. Window joint 200 is a tubular member 202 that is threadably interconnectable within a casing string. Window joint 200 has a preformed window 204 that is defined by a score line 206. As illustrated, score line 206 is formed in the interior surface of window joint 200 such that preformed window 204 extends circumferentially approximately 170 degrees. Even though preformed window 204 has been described as having a particular circumferential width, it should be understood by those skilled in the art that a preformed window in a window joint of the present invention may have other circumferential widths both greater than or less than 170 degrees. As best seen in FIG. 5B, score line 206 is depicted as a V-shaped recess 208 that is etched, scored or otherwise formed into the inner surface of tubular member 202 creating preferential weakening of window joint 200 for removal of preformed window 204. The depth of recess 208 will determine the force required to remove preformed window 204 from window joint 200. Additionally, window joint 200 includes a circumferential protrusion or tab 210 disposed proximate a circumferential portion of score lines 206 that extends inwardly from the inner surface of preformed window 204. Tab 210 is designed for engagement with an operating tool of a window removal tool of the present invention. The orientation of score line 206 as well as the orientation of tab 210 enable opening and removal of preformed window 204 with a force applied toward the central axis of window joint 200 and preferably a force applied in the uphole direction.

Referring now to FIGS. 6A-6B, a window joint for use in lateral wellbore construction is schematically illustrated and generally designated 220. Window joint 220 is a tubular member 222 that is threadably interconnectable within a casing string. Window joint 220 has a preformed window 224 that is defined by score lines 226, 228. As illustrated, score line 226 is formed in the interior surface of window joint 220 and score line 228 is formed in the outer surface of window joint 220 such that preformed window 224 extends circumferentially approximately 170 degrees. As best seen in FIG. 6B, score lines 226, 228 are depicted as V-shaped recesses 230, 232 that are etched, scored or otherwise formed into the surface of tubular member 222 creating preferential weakening of window joint 220 for removal of preformed window 224. The depth of recesses 230, 232 will determine the force required to remove preformed window 224 from window joint 220. Additionally, window joint 220 includes a circumferential protrusion or tab 234 disposed proximate a circumferential portion of score lines 226 that extends inwardly from the inner surface of preformed window 224. Tab 234 is designed for engagement with an operating tool of a window removal tool of the present invention. The orientation of score lines 226, 228 as well as the orientation of tab 234 enable opening and removal of preformed window 224 with a force applied toward the central axis of window joint 220 and preferably a force applied in the uphole direction.

Referring now to FIGS. 7A-7B, a window joint for use in lateral wellbore construction is schematically illustrated and generally designated 240. Window joint 240 is a tubular member 242 that is threadably interconnectable within a casing string. Window joint 240 has a preformed window 244 that is defined by a score line 246. As illustrated, score line 246 is formed in the interior surface of window joint 240 such that preformed window 244 extends circumferentially approximately 170 degrees. Window joint 240 further includes score lines 248, 250, 252 that extend substantially longitudinally along the inner surface of tubular member 242. As best seen in FIG. 7B, score line 246 is depicted as V-shaped recess 254. Likewise, score lines 248, 250, 252 may be V-shaped recesses such as the V-shaped recess 256 illustrated for score line 252. Score lines 246, 248, 250, 252 are etched, scored or otherwise formed into the surface of tubular member 242 creating preferential weakening of window joint 240 for removal of preformed window 244. The depth of the recesses will determine the force required to remove preformed window 244 from window joint 240. Additionally, window joint 240 includes a longitudinal protrusion or tab (not illustrated) disposed proximate a longitudinal portion of score line 246 that extends inwardly from the inner surface of preformed window 244. The tab is designed for engagement with an operating tool of a window removal tool of the present invention. The orientation of score lines 246, 248, 250, 252 as well as the orientation of the tab enable opening or removal of preformed window 244 with a torque applied toward the central axis of window joint 240.

Figure 8A:
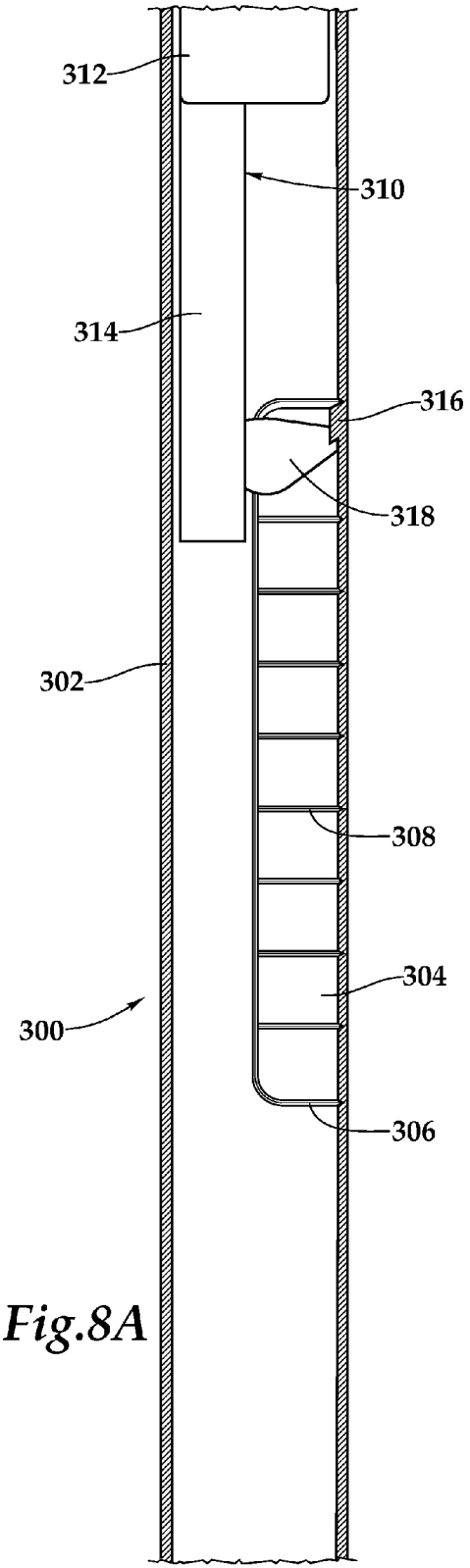
FIGS. 8A-8C are cross sectional views of a window joint during the opening of a window in a casing string for lateral wellbore construction according to an embodiment of the present invention at various stages of the window removal process.
Figure 8B:
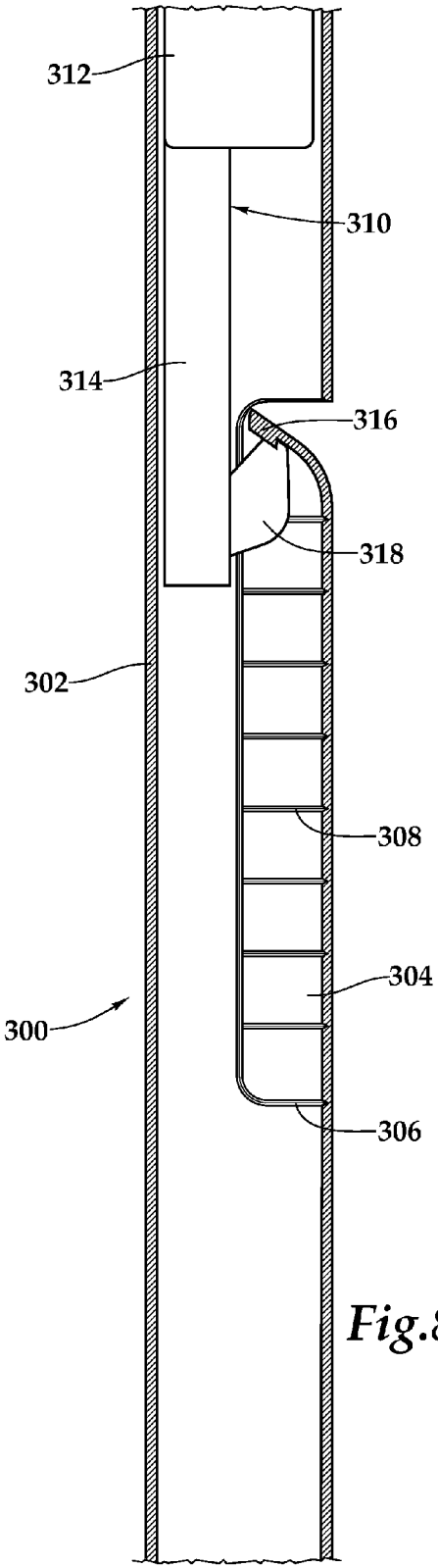
Figure 8C:
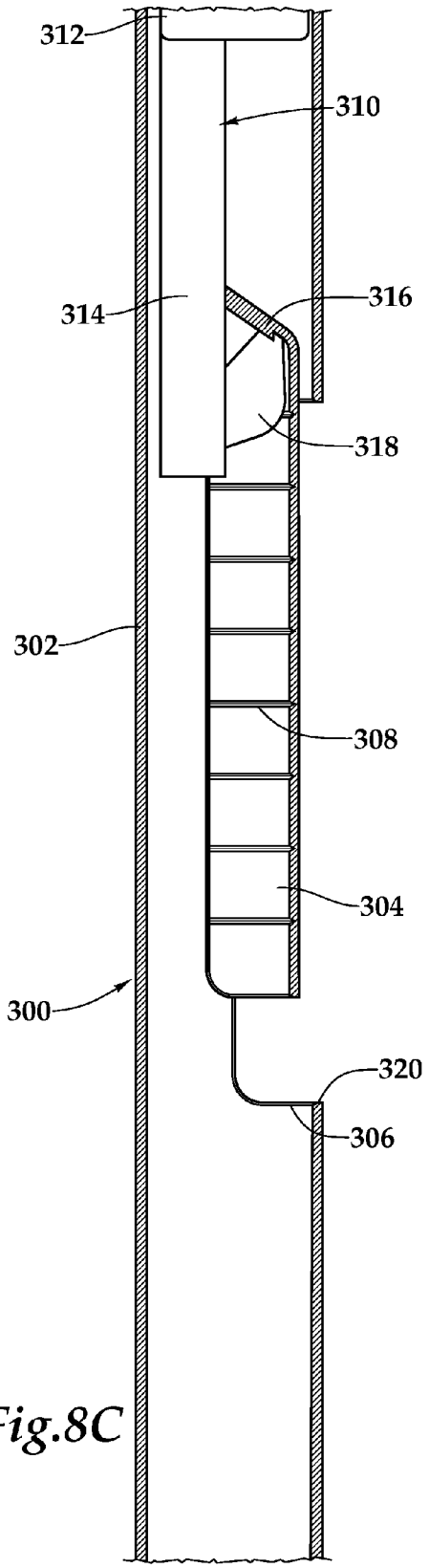

Referring now to FIGS. 8A-8C, a window joint for use in lateral wellbore construction is schematically illustrated and generally designated 300. Window joint 300 is a tubular member 302 that is threadably interconnectable within a casing string. Window joint 300 has a preformed window 304 that is defined by a score line 306. As illustrated, score line 306 is formed in the interior surface of window joint 300 such that preformed window 304 extends circumferentially approximately 170 degrees. Window joint 300 further includes additional score lines, such as score line 308, that extend substantially circumferentially along the inner surface of tubular member 302 that reduce the force required to open and remove preformed window 304. Positioned within window joint 300 is a window removal tool 310, only a bottom portion of which is illustrated. Window removal tool 310 preferably includes an anchoring assembly (not pictured) such as the latch assembly described above that longitudinally and rotationally secures window removal tool 310 within the casing string. Window removal tool 310 also includes a power assembly 312 such as that described above for generating a longitudinal force. Window removal tool 310 further includes an operating tool 314 that operably engages with tab 316 of preformed window 304 via rotatable member 318.

In operation, once window removal tool 310 is secured within the casing string such that operating tool 314 is located relative to preformed window 304, power assembly 312 is actuated to generate a longitudinal force. The longitudinal force operates on operating tool 314 shifting a piston or sleeve therein which causes rotational movement of rotatable member 318. When rotatable member 318 has engaged with tab 316, as best seen in FIG. 8A, further rotational movement of rotatable member 318 causes preformed window 304 to tear apart from window joint 300 along score line 306, as best seen in FIG. 8B. Further rotational movement of rotatable member 318 and longitudinal uphole movement of operating tool 314 causes preformed window 304 to open along score line 306, as best seen in FIG. 8C, creating window 320 in window joint 300. Thereafter, window removal tool 310 is released from the casing string and retrieved to the surface with preformed window 304.

Figure 9:
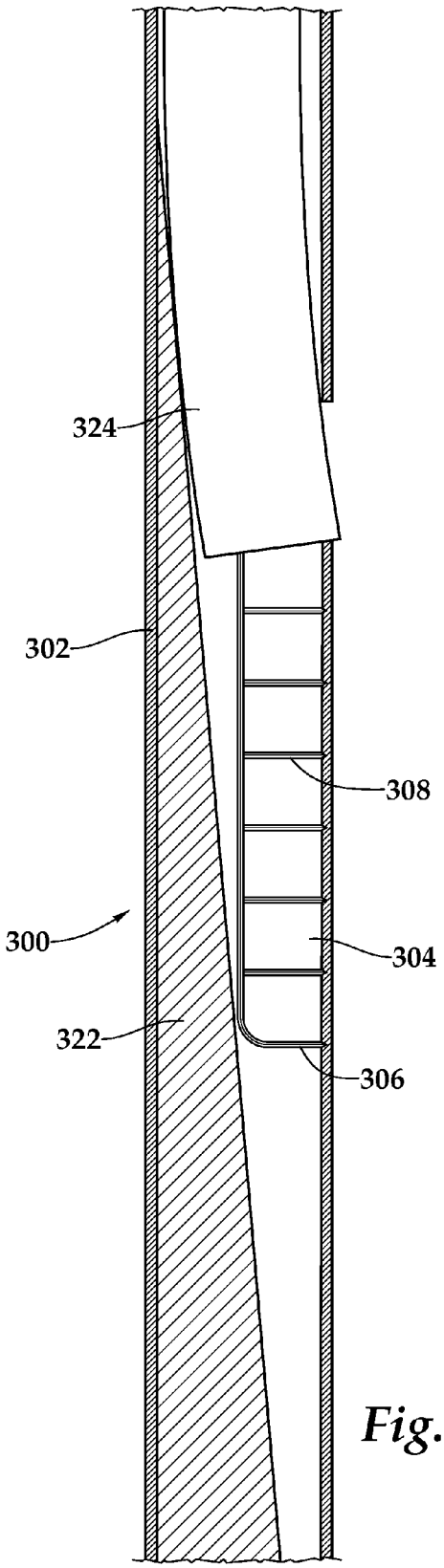
FIG. 9 is a cross sectional view of a window joint having a window removed therefrom according to an embodiment of the present invention.

Alternatively, as best seen in FIG. 9, after rotatable member 318 has engaged with tab 316 and caused preformed window 304 to tear apart from window joint 300 along score line 306, as best seen in FIG. 8B, operating tool 314 may be released from preformed window 304 and retrieved to the surface. Thereafter, a deflector assembly 322 may be installed within the casing string or was preinstalled within the casing string such that a fishing tool 324 may be engaged with the upper portion of preformed window 304 to complete the opening process and retrieve preformed window 304 to the surface.

Figure 10A:
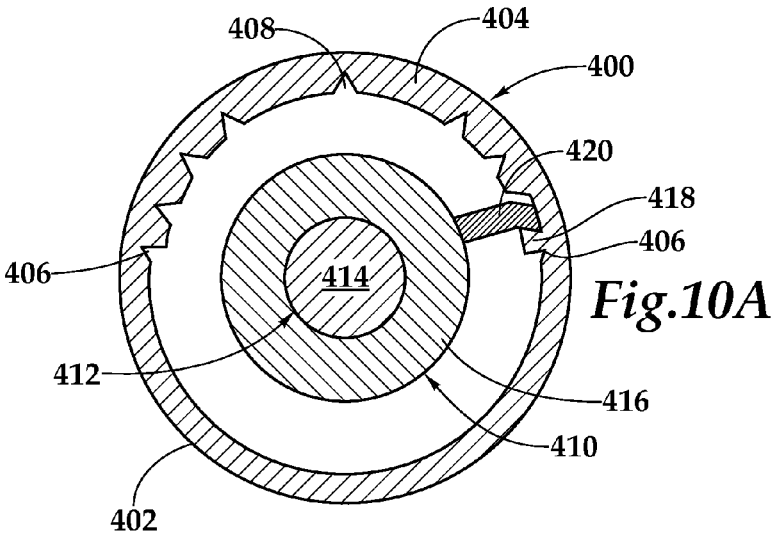
FIGS. 10A-10C are cross-sectional views of a window joint during the opening of a window in a casing string for lateral wellbore construction according to an embodiment of the present invention at various stages of the window removal process.
Figure 10B:
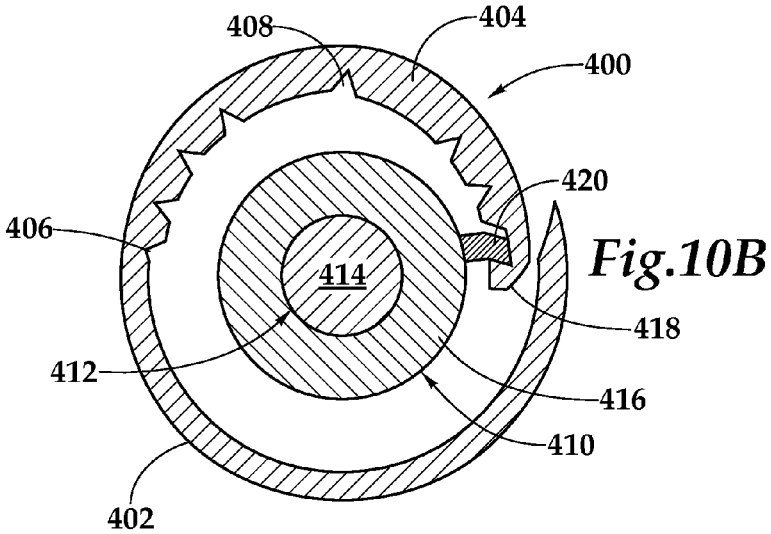
Figure 10C:
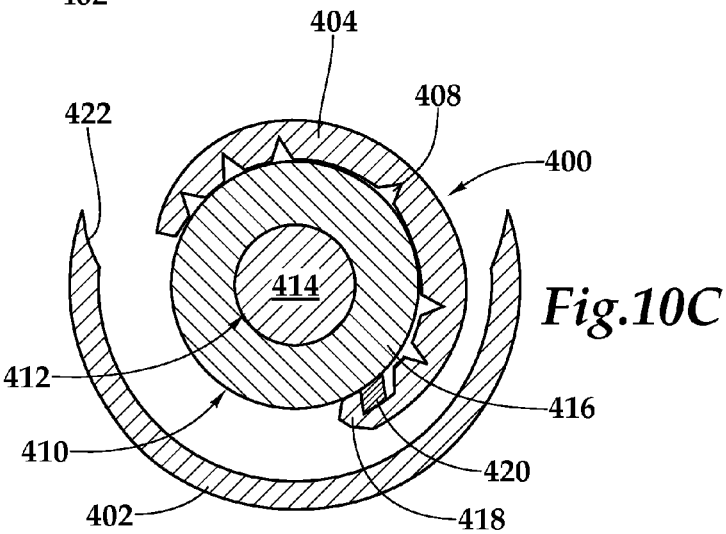

Referring now to FIGS. 10A-10C, a window joint for use in lateral wellbore construction is schematically illustrated and generally designated 400. Window joint 400 is a tubular member 402 that is threadably interconnectable within a casing string. Window joint 400 has a preformed window 404 that is defined by a score line 406. As illustrated, score line 406 is formed in the interior surface of window joint 400 such that preformed window 404 extends circumferentially approximately 170 degrees. Window joint 400 further includes additional score lines, such as score line 408, that extend substantially longitudinally along the inner surface of tubular member 402 that reduce the force required to open and remove preformed window 404. Positioned within window joint 400 is a window removal tool 410. Window removal tool 410 preferably includes an anchoring assembly (not pictured) such as the latch assembly described above that longitudinally and rotationally secures window removal tool 410 within the casing string. Window removal tool 410 also includes a power assembly 412 such as that described above for generating a rotational torque, only a shaft 414 of power assembly 412 being visible. Window removal tool 410 further includes an operating tool 416 that operably engages with tab 418 of preformed window 404 via arm member 420.

In operation, once window removal tool 410 is secured within the casing string such that operating tool 416 is located relative to preformed window 404, power assembly 412 is actuated to generate a rotational torque. The rotational torque operates on operating tool 416 which causes rotational movement of arm member 420. When arm member 420 has engaged with tab 418, as best seen in FIG. 10A, further rotational movement of arm member 420 causes preformed window 404 to tear apart from window joint 400 along score line 406, as best seen in FIG. 10B. Further rotational movement of arm member 420 causes preformed window 404 to open along score line 406, as best seen in FIG. 10C, creating window 422 in window joint 400. Thereafter, window removal tool 410 is released from the casing string and retrieved to the surface with preformed window 404.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A system for opening a window in a casing string during lateral wellbore construction, the system comprising:

a window joint operable to be interconnected within the casing string, the window joint having a preformed window formed therein defined by at least one score line that creates a preferentially weakened region within the window joint enabling internal removal of the preformed window in a predictable manner, the at least one score line having at least one section extending circumferentially about a portion of the window joint and at least one section extending longitudinally about a portion of the window joint, the preformed window having a generally radially extending tab disposed on an interior surface thereof, the tab having a first surface and a second surface that is oppositely disposed from the first surface and that is defined by at least a portion of the at least one score line; and a window removal tool operable to be run in the casing string and operably engagable with the first surface of the tab such that actuation of the window removal tool removes the preformed window as a single piece from the window joint to an interior of the casing string, thereby opening the window, and wherein, retrieval of the window removal tool to a surface of the wellbore retrieves the preformed window as the single piece to the surface of the wellbore through the interior of the casing string.

2. The system as recited in claim 1 wherein the at least one score line further comprises at least one score line is formed on an exterior surface of the window joint.

3. The system as recited in claim 1 wherein the at least one score line further comprises at least one score line formed on an interior surface of the window joint and at least one score line formed on an exterior surface of the window joint.

4. The system as recited in claim 1 wherein the window removal tool further comprises an anchor assembly, a power assembly and an operating tool, the anchor assembly operable to secure the window removal tool in the casing string, the power assembly operable to provide movement to the operating tool and the operating tool operably engagable with the preformed window.

5. The system as recited in claim 4 wherein the power assembly is selected from the group consisting of an electrically operated power assembly, a hydraulically operated power assembly and hydrostatically operated power assembly.

6. The system as recited in claim 4 wherein the power assembly is operable to provide longitudinal movement to the operating tool.

7. The system as recited in claim 4 wherein the power assembly is operable to provide rotational movement to the operating tool.

8. A method for opening a window in a casing string during lateral wellbore construction, the method comprising:

interconnecting a window joint within the casing string, the window joint having a preformed window formed therein defined by at least one score line that creates a preferentially weakened region within the window joint enabling internal removal of the preformed window in a predictable manner, the at least one score line having at least one section extending circumferentially about a portion of the window joint and at least one section extending longitudinally about a portion of the window joint, the preformed window having a generally radially extending tab disposed on an interior surface thereof the tab having a first surface and a second surface that is oppositely disposed from the first surface and that is defined by at least a portion of the at least one score line;

installing the casing string in a wellbore;

running a window removal tool in the casing string;

operatively engaging the window removal tool with the first surface of the tab;

actuating the window removal tool;

removing the preformed window as a single piece from the window joint to an interior of the casing string with the window removal tool, thereby opening the window; and retrieving the preformed window as the single piece to a surface of the wellbore through the interior of the casing string with the window removal tool.

9. The method as recited in claim 8 further comprising anchoring the window removal tool in the casing string.

10. The method as recited in claim 8 wherein actuating the window removal tool further comprises applying longitudinal force with the window removal tool to the preformed window.

11. The method as recited in claim 8 wherein actuating the window removal tool further comprises applying rotational torque with the window removal tool to the preformed window.

* * * * *